US009604768B2

(12) United States Patent
Ramsuer et al.

(10) Patent No.: US 9,604,768 B2
(45) Date of Patent: Mar. 28, 2017

(54) CARTON AND CARTON BLANK

(71) Applicant: WestRock Packaging Systems, LLC, Norcross, GA (US)

(72) Inventors: Brandon L. Ramsuer, Henrico, VA (US); Nathaniel B. Ball, Richmond, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/897,417

(22) PCT Filed: Jun. 17, 2014

(86) PCT No.: PCT/US2014/042614

§ 371 (c)(1),
(2) Date: Dec. 10, 2015

(87) PCT Pub. No.: WO2014/204886

PCT Pub. Date: Dec. 24, 2014

(65) Prior Publication Data

US 2016/0145020 A1 May 26, 2016

Related U.S. Application Data

(60) Provisional application No. 61/837,068, filed on Jun. 19, 2013.

(51) Int. Cl.
*B65D 71/36* (2006.01)
*B65D 5/54* (2006.01)

(52) U.S. Cl.
CPC ..... *B65D 71/36* (2013.01); *B65D 5/5495* (2013.01); *B65D 2571/0045* (2013.01);
(Continued)

(58) Field of Classification Search
CPC ..... B65D 71/36; B65D 5/5495; B65D 5/5445
(Continued)

(56) References Cited

U.S. PATENT DOCUMENTS 3,158,312 A 11/1964 Simkins
3,677,458 A 7/1972 Gosling
(Continued)

FOREIGN PATENT DOCUMENTS

CN 102050251 A 5/2011
EP 0428397 B1 9/1996
(Continued)

*Primary Examiner* — Christopher Demeree
(74) *Attorney, Agent, or Firm* — WestRock Intellectual Property Group

(57) ABSTRACT

A carton (90) for packaging articles comprising a first plurality of walls (12, 14, 16, 18, 20) including a top wall (20), base wall (16), first side wall (14) and second side wall (18) forming a first tubular structure, each end of the first tubular structure being at least partially closed by one or more end closure panels (32*a*, 34*a*, 36*a*, 38*a*, 32*b*, 34*b*, 36*b*, 38*b*), wherein the carton comprises an end pull device (E) for withdrawing the carton from a display apparatus wherein the end pull device comprises a first recess struck from an end of the first side wall panel whereby facilitating access to an edge of the one or more end closure panels at the adjacent end of the first tubular structure.

18 Claims, 8 Drawing Sheets

(52) U.S. Cl.
CPC ..... *B65D 2571/0066* (2013.01); *B65D 2571/00141* (2013.01); *B65D 2571/00339* (2013.01); *B65D 2571/00444* (2013.01); *B65D 2571/00574* (2013.01); *B65D 2571/00635* (2013.01); *B65D 2571/00728* (2013.01); *B65D 2571/00864* (2013.01)

(58) Field of Classification Search
USPC ..... 229/120.011, 120.11, 120.08, 120.02, 229/235; 206/192
See application file for complete search history.

(56) References Cited

U.S. PATENT DOCUMENTS

| | | | | |
|---|---|---|---|---|
| 4,913,291 | A * | 4/1990 | Schuster | B65D 5/5495 229/120.011 |
| 4,919,269 | A | 4/1990 | Wright et al. | |
| 5,505,370 | A * | 4/1996 | Brown | B65D 5/5495 229/120.03 |
| 5,579,911 | A | 12/1996 | Werth | |
| 5,699,957 | A | 12/1997 | Blin et al. | |
| 6,913,189 | B2 | 7/2005 | Oliff et al. | |
| 8,479,973 | B2 | 7/2013 | Brand | |
| 2004/0164133 | A1 | 8/2004 | Harrelson | |
| 2007/0227927 | A1 | 10/2007 | Coltri-Johnson | |
| 2008/0054053 | A1 | 3/2008 | Merzeau | |

FOREIGN PATENT DOCUMENTS

| | | |
|---|---|---|
| EP | 1533239 A2 | 5/2005 |
| FR | 2584048 | 1/1987 |
| WO | 2012/094557 | 7/2012 |

* cited by examiner

CARTON AND CARTON BLANK

REFERENCE TO RELATED APPLICATIONS

This application is a National Phase application of PCT Application No. PCT/US2014/042614, filed Jun. 17, 2014, which claims the benefit of U.S. Provisional Patent Application No. 61/837,068, filed Jun. 19, 2013, which is incorporated herein by reference in its entirety.

FIELD OF THE INVENTION

The present invention relates to a carton for packaging one or more articles and a carton blank for forming the same more specifically, but not exclusively, to a carton having an end pull device for facilitating withdrawal of a carton from a shelf.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide multi-packs with features such as, but not limited to, end pull devices such that when multiple packages are disposed in a stacked configuration in close proximity upon a shelf or other display means a consumer can readily slide one of the packages from the stack.

The present invention seeks to overcome or at least mitigate the problems of the prior art.

SUMMARY OF INVENTION

According to a first aspect of the present invention there is provided a carton for packaging articles comprising a first plurality of walls including a top wall, base wall, first side wall and second side wall forming a first tubular structure, each end of the first tubular structure being at least partially closed by one or more end closure panels, wherein the carton comprises an end pull device for withdrawing the carton from a display apparatus wherein the end pull device comprises a first recess defined at an end of the first side wall panel thereby facilitating access to an edge of a first end closure panel.

Optionally, the first end closure panel comprises a second recess defined along a side edge thereof.

Optionally, the carton comprises a second end closure panel hinged to an end edge of the first side wall panel, and a third recess is defined at the second end closure panel the first recess and the third recess together forming an aperture which interrupts the hinged connection between the second end closure panel and the first side wall panel.

In some embodiments the first end closure panel comprises a second recess defined along a side edge thereof arranged to be in registry with a portion of the aperture when the first end closure panel is in overlapping relationship with the second end closure panel.

The end pull device may comprise a fourth recess defined at an end of the second side wall panel.

Optionally, the fourth recess is disposed at an elevation above the base panel substantially equal to the elevation of the first recess above the base panel.

In some embodiments the second side wall panel comprises a free end edge.

Optionally, the carton comprises a second plurality of walls including a top wall, base wall, first side wall and second side wall forming a second tubular structure, each end of the second tubular structure being at least partially closed by one or more end closure panels, wherein the carton comprises a second end pull device for withdrawing the carton from a display apparatus wherein the second end pull device comprises a first recess defined at an end of the first side wall panel of the second tubular structure thereby facilitating access to an edge of a first end closure panel of the second tubular structure.

In some embodiments the top wall of the second tubular structure is coupled to the top wall of the first tubular structure by a frangible connection, wherein the first tubular structure forms part of a first package and the second tubular structure forms part of a second package, and wherein the first package is detachable from the second package.

Optionally, the first end pull device is disposed at a first end of the carton and the second end pull device is disposed at second end of the carton, the second end opposing the first end.

Preferably, the second side wall panel of the first package and the second side wall panel of the second package are disposed in face contacting relationship with each other and form an internal divider structure between two adjacent rows of articles.

Optionally, the second side wall panel of the first package and the second side wall panel of the second package are secured to each other by glue or other adhesive treatment.

According to a second aspect of the present invention there is provided a carton for packaging articles comprising a first plurality of walls including a top wall, base wall, first side wall and second side wall forming a first tubular structure, each end of the first tubular structure being at least partially closed by one or more end closure panels to form a first package, wherein the carton comprises a first end pull device for withdrawing the first package from a display apparatus wherein the first end pull device comprises a first recess defined at an end of the first side wall panel of the first tubular structure thereby facilitating access to an edge of a first end closure panel of the first tubular structure, the carton comprising a second plurality of walls including a top wall, base wall, first side wall and second side wall forming a second tubular structure, each end of the second tubular structure being at least partially closed by one or more end closure panels to form a second package, wherein the carton comprises a second end pull device for withdrawing the second package from a display apparatus and wherein the second end pull device comprises a second recess defined at an end of the first side wall panel of the second tubular structure thereby facilitating access to an edge of a first end closure panel of the second tubular structure and wherein the first package is frangibly connected to the second package.

The first end pull device may be disposed at a first end of the carton and the second end pull device may be disposed at second end of the carton, the second end opposing the first end.

According to a third aspect of the present invention there is provided a blank for forming a carton comprising a first plurality of panels for forming a first tubular structure including a top wall, base wall, first side wall and second side wall in a set-up condition, the blank comprising one or more end closure panels for at least partially closing each end of the first tubular structure, wherein the blank comprises an end pull device for withdrawing a set-up carton from a display apparatus wherein the end pull device comprises a first recess defined at an end of the first side wall panel for facilitating access to an edge of a first end closure panel.

According to a fourth aspect of the present invention there is provided a blank for forming a carton comprising a first plurality of panels for forming a first tubular structure including a top wall, base wall, first side wall and second side wall in a set-up condition, the blank comprising one or more end closure panels for at least partially closing each end of the first tubular structure to form a first package, wherein the blank comprises a first end pull device for withdrawing the first package when in a set-up condition from a display apparatus wherein the first end pull device comprises a first recess defined at an end of the first side wall panel of the first tubular structure for facilitating access to an edge of a first end closure panel of the first tubular structure, the blank comprising a second plurality of panels for forming a second tubular structure including a top wall, base wall, first side wall and second side wall in a set-up condition, the blank comprising one or more end closure panels for at least partially closing each end of the second tubular structure to form a second package, wherein the blank comprises a second end pull device for withdrawing the second package when in a set-up condition from the display apparatus and wherein the second end pull device comprises a second recess defined at an end of the first side wall panel of the second tubular structure thereby facilitating access to an edge of a first end closure panel of the second tubular structure, and wherein the first plurality of panels are frangibly connected to the second plurality of panels.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
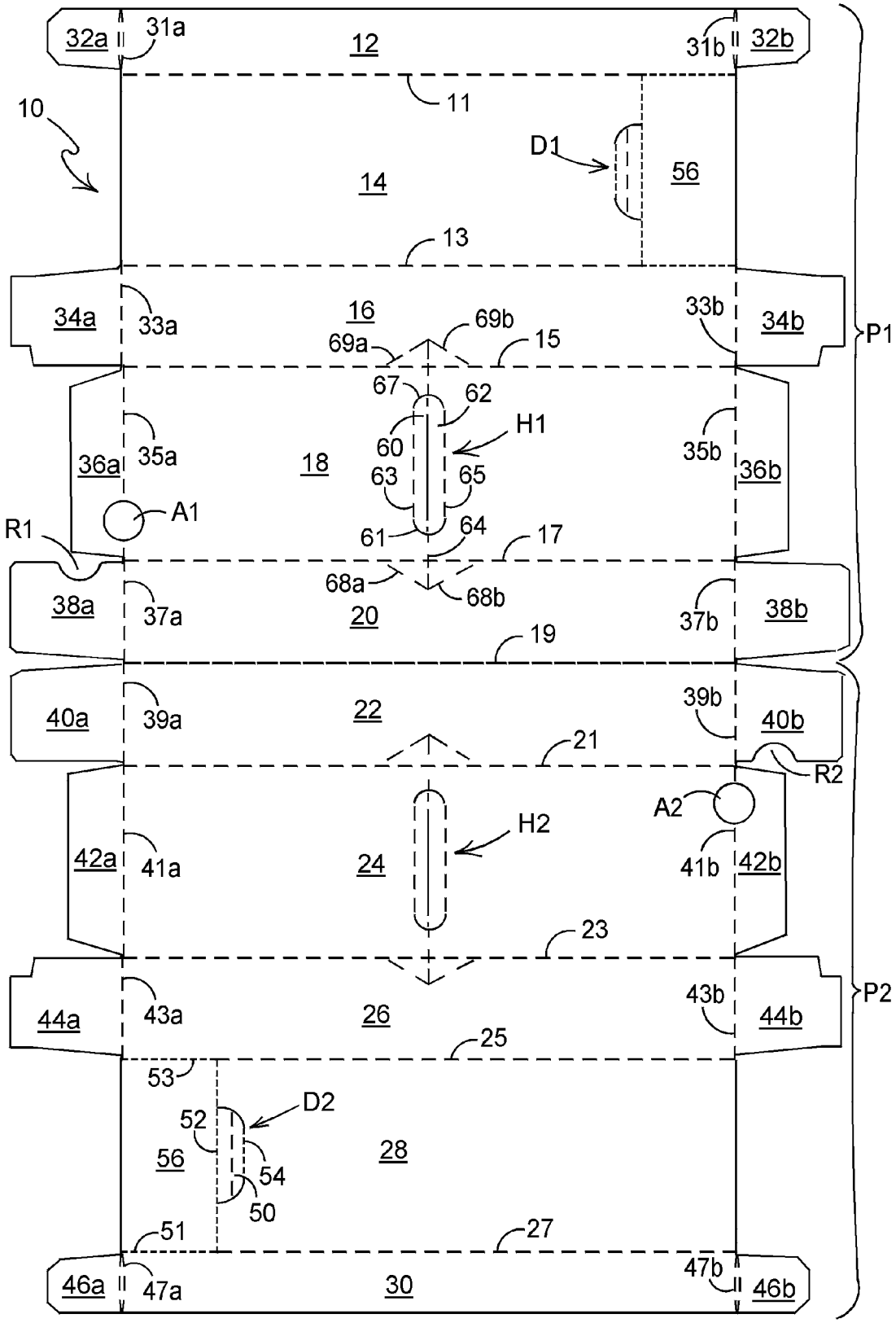
FIG. 1 is a plan view from above of a blank for forming a carton according to a first embodiment of the invention.

Referring to FIG. 1 there is shown a plan view of a blank 10 capable of forming a carton 90, shown in FIG. 2, for packaging one or more primary product containers such as, but not limited to, bottles or cans, hereinafter referred to as articles.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blank is configured to form a carton or carrier for packaging an exemplary arrangement of exemplary articles. In a first illustrated exemplary embodiment, the arrangement is a 2×6 matrix and the articles are cans. The blank can be alternatively configured to form a carrier for packaging other types, number and size of article and/or for packaging articles in a different arrangement or configuration.

The blank 10 comprises a plurality of panels for forming a carton 90. The carton 90 is divisible into two separate carton units or packages. A first set of panels P1 of the blank 10 forms a first carton or first package and a second set of panels P2 of the blank 10 forms a second carton or second package.

The blank 10 comprises a plurality of main wall panels 12, 14, 16, 18, 20 for forming a first package. The first package comprises: a first or inner top wall 12, a first side wall 14, a bottom wall 16, a second side wall 18 and a second or outer top wall 20 in a set-up condition. The inner top wall panel 12 is hinged to the first side wall panel 14 by a fold line 11. The first side wall panel 14 is hinged to the bottom wall panel 16 by a fold line 13. The bottom wall panel 16 is hinged to the second side wall panel 18 by a fold line 15. The outer top wall panel 20 is hinged to the second side wall panel 18 along a fold line 17.

The blank 10 also comprises a plurality of main wall panels 22, 24, 26, 28, 30 for forming a second package. The second package comprises: a first or inner top wall 30, a first side wall 28, a bottom wall 26, a second side wall 24 and a second or outer top wall 22 in a set-up condition. The outer top wall panel 22 is hinged to the second side wall panel 24 by a fold line 21. The second side wall panel 24 is hinged to the bottom wall panel 26 by a fold line 23. The bottom wall panel 26 is hinged to the first side wall panel 28 by a fold line 25. The inner top wall panel 30 is hinged to the first side wall panel 28 along a fold line 27.

The plurality of main panels 12, 14, 16, 18, 20 of the first package form a tubular structure in a set-up condition. Each of the ends of the tubular structure of the first package are at least partially closed by end closure panels 32*a*, 34*a*, 36*a*, 38*a*, 32*b*, 34*b*, 36*b*, 38*b*. End closure panels 32*a*, 34*a*, 36*a*, 38*a* are configured to close a first end of the tubular structure and end panels 32*b*, 34*b*, 36*b*, 38*b* are configured to close a second end of the tubular structure. A first end closure panel 32*a* is hinged to a first end of inner top wall panel 12 by a pair of arcuate fold lines 31*a*. A second end closure panel 34*a* is hinged to a first end of bottom panel 16 by a fold line 33*a*. A third end closure panel 36*a* is hinged to a first end of second side wall panel 18 by a fold line 35*a*. A fourth end closure panel 38*a* is hinged to a first end of the outer top wall panel 20 by a fold line 37*a*.

A fifth end closure panel 32*b* is hinged to a second end of inner top wall panel 12 by a pair of arcuate fold lines 31*b*. A sixth end closure panel 34*b* is hinged to a second end of bottom wall panel 16 by a fold line 33*b*. A seventh end closure panel 36*b* is hinged to a second end of second side panel 18 by a fold line 35*b*. An eighth end closure panel 38*b* is hinged to a second end of the outer top wall panel 20 by a fold line 37*b*.

The third end closure panel 36*a* and the seventh end closure panel 36*b* each form a minor side end closure panel. The second end closure panel 34*a* and the sixth end closure panel 34*b* each form a major lower end closure panel. The fourth end closure panel 38*a* along with the first end closure panel 32*a* forms a major upper end closure panel. The eighth end closure panel 38*b* along with the fifth end closure panel 32*b* also forms a major upper end closure panel.

The plurality of main panels 22, 24, 26, 28, 30 of the second package form a tubular structure in a set-up condition. Each of the ends of the tubular structure of the second package are at least partially closed by end closure panels 40*a*, 42*a*, 44*a*, 46*a*, 40*b*, 42*b*, 44*b*, 46*b*. End closure panels 40*a*, 42*a*, 44*a*, 46*a* are configured to close a first end of the tubular structure and end panels 40*b*, 42*b*, 44*b*, 46*b* are configured to close a second end of the tubular structure. A first end closure panel 40*a* is hinged to a first end of second or outer top wall panel 22 by a fold line 39*a*. A second end closure panel 42*a* is hinged to a first end of second side panel 24 by a fold line 41*a*. A third end closure panel 44*a* is hinged to a first end of bottom wall panel 26 by a fold line 43*a*. A fourth end closure panel 46*a* is hinged to a first end of the inner top wall panel 30 by a pair of arcuate fold lines 47*a*.

A fifth end closure panel 40*b* is hinged to a second end of second or outer top wall panel 22 by a fold line 39*b*. A sixth end closure panel 42*b* is hinged to a second end of second side wall panel 24 by a fold line 41*b*. A seventh end closure panel 44*b* is hinged to a second end of bottom panel 26 by a fold line 43*b*. An eighth end closure panel 46*b* is hinged to a second end of the inner top wall panel 30 by a pair of arcuate fold lines 47*b*.

The outer top panel 20 of the first package is coupled to the outer top panel 22 of the second package by a frangible line 19. The outer top panel 20 of the first package and the outer top panel 22 of the second package form a common top wall 20/22 of the carton 90.

The second side wall panel 18 of the first package forms a first outer side wall 18 of the carton 90. The second side wall panel 24 of the second package forms a second outer side wall 24 of the carton 90.

The bottom panel 16 of the first package forms a first part 16 of a base wall 16/26 of the carton 90. The bottom panel 26 of the second package forms a second part 26 of a base wall 16/26 of the carton 90.

The end closure panels 32*a*, 34*a*, 36*a*, 38*a* of the first package and the end closure panels 40*a*, 42*a*, 44*a*, 46*a* of the second package form a first end wall of the carton 90.

The end closure panels 32*b*, 34*b*, 36*b*, 38*b* of the first package and the end closure panels 40*b*, 42*b*, 44*b*, 46*b* of the second package form a second end wall of the carton 90.

The first side wall panel 14 of the first package and the first side wall panel 28 of the second package form an internal divider structure in the set-up carton 90. The internal divider structure separates a first row of articles disposed in the first package from a second row of articles disposed in the second package.

The blank 10 comprises a pair of handle structures H1, H2. A first handle structure H1 is provided in the first package, which comprises a pair of elongate tabs 60, 62, which are defined in part by a severance line 64. The severance line 64 extends transversely across the second side wall panel 18 and into each of the bottom wall panel 16 and the outer top wall panel 20. A first elongate tab 60 is defined in part by a first fold line 63, which is disposed in a spaced apart parallel relationship to the severance line 64. A second elongate tab 62 is defined in part by a second fold line 65 which is disposed in a spaced apart parallel relationship to the severance line 64. The first and second fold lines 63, 65 are disposed on opposing sides of the severance line 64. A first arcuate cutline 61 defines first ends of each of the first and second elongate tabs 60, 62. The first arcuate cutline 61 extends between a first end of the first fold line 63 and a first end of the second fold line 65, across the severance line 64. A second arcuate cutline 67 defines second ends of each of the first and second elongate tabs 60, 62. The second arcuate cutline 67 extends between a second end of the first fold line 63 and a second end of the second fold line 65, across the severance line 64.

The first handle structure H1 comprises a pair of fold lines or crease lines 69*a*, 69*b* at a first end of weakened line of severance 64. The first end of the severance line 64 is disposed in the bottom wall panel 16 and terminates in a "V" shaped cutline wherein each of the arms of the "V" shaped cutline form a vertex, the vertex being disposed at the first end of the severance line 64.

A first crease line 69*a* commences from a first end of the V" shaped cutline towards the fold line 15 between the bottom wall panel 16 and the second side wall panel 18. A second crease line 69*b* commences from a second end of the V" shaped cutline towards the fold line 15 between the bottom wall panel 16 and the second side wall panel 18. The first and second crease lines 69*a*, 69*b* together with the "V" shaped cutline form a "V" shape which converges at the first end of the severance line 64.

The first handle structure H1 comprises a second pair of fold lines or crease lines 68*a*, 68*b* at a second end of weakened line of severance 64. The second end of the severance line 64 is disposed in the outer top wall panel 20 and terminates in "V" shaped cutline wherein each of the arms of the "V" shaped cutline form a vertex, the vertex being disposed at the second end of the severance line 64.

A third crease line 68*a* commences from a first end of the "V" shaped cutline towards the fold line 17 between the outer top wall panel 20 and the second side wall panel 18. A crease line 68*b* commences from a second end of the V" shaped cutline towards the fold line 17 between the outer top wall panel 20 and the second side wall panel 18. The third and fourth crease lines 68*a*, 68*b* together with the "V" shaped cutline form a "V" shape which converges at the second end of the severance line 64.

A second handle structure H2 is provided in the second package is substantially the same in construction as the first handle structure H1.

The blank 10 comprises a pair of access devices D1, D2. A first access device D1 is provided in the portion of the blank 10 forming the first package. A second access device D2 is provided in the portion of the blank 10 forming the second package. The first access device D1 is substantially the same as the second device D2, and the access devices D1, D2 will be described by reference to the second access device D2.

The second access device D2 is provided for removal of a portion 56 of the second side wall panel 28 of the second package. Removal of said portion 56 facilitates access to the contents of the second package.

The second access device D2 comprises a plurality of weakened lines of severance 51, 53, 54 which define at least in part a removable portion 56 of the first side wall panel 28. The plurality of weakened lines of severance 51, 53, 54 includes: a first weakened line of severance 53 which extends from an end edge of the first side wall panel 28 along a portion of the fold line 25 between the bottom panel 26 and the first side wall panel 28; a second weakened line of severance 54 extends from an end of first weakened line of severance 53 across the first side wall 28 from the fold line 25 to the fold line 27 between the first side wall panel 28 and the inner top wall panel 30; and a third weakened line of severance 51 extends from an end of second weakened line of severance 54 along a portion of the fold line 27, between the first side wall panel 28 and the inner top wall panel 30, to the end edge of the first side wall panel 28.

The access device D2 comprises an optional tear initiation tab 50 defined in part by the second weakened line of severance 54 and in part by a fold line 52. The tear initiation tab 50 is hinged to the removable portion 56 of the first side wall panel 28 by the fold line 52. The tear initiation tab 50 is detachable from the second package along with the removable portion 56.

Figure 3:
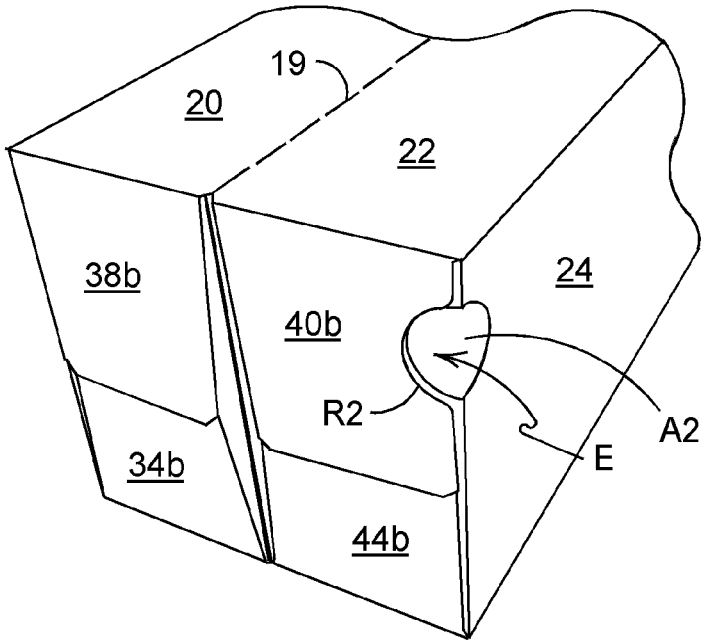
FIGS. 3 and 4 are perspective views from above of an end portion of the carton of FIG. 2.

The blank 10 comprises a pair of end pull devices E, see FIG. 3. The first package comprises a first end pull device E comprising an aperture A1 and a recess R1. The aperture A1 is struck in part from the second side wall panel 18 of the first package and in part from the third end closure panel 36*a*. The aperture A1 interrupts the fold line 35*a* between the second side wall panel 18 and third end closure panel 36*a*. The recess R1 is struck from, or otherwise defined along, a first side edge of the fourth end closure panel 38*a*. The aperture A1 and the recess R1 are arranged such that when the blank 10 is assembled into a carton 90, the recess R1 is in registry with a portion of the aperture A1. Aperture A1 may be considered as a recess struck from, or otherwise defined along, an end edge of the second side wall panel 18 and a recess struck from, or defined along, a side edge of the third end closure panel 36*a*, the recesses together forming an aperture which interrupts the fold line 35*a*.

Optionally, the fourth end closure panel 38*a* is tapered in shape. The fourth end closure panel 38*a* comprises a second side edge which opposes the first side edge from which the recess R1 is struck. The second side edge is arranged so as to converge towards the first side edge. In this way, the free end edge of the fourth end closure panel 38*a* is shorter in length dimension than the hinged end edge which is hinged to the outer top wall panel 20 of the first package. A corresponding second side edge of the second end closure panel 34*a* is arranged to be contiguous with the second side edge of the fourth end closure panel 38*a* in a set-up carton. The second end closure panel 34*a* is also tapered in shape, such that the free end edge of the second end closure panel 34*a* is shorter in length dimension than the hinged end edge which is hinged to the bottom wall panel 16 of the first package. In some embodiments the second side edges of the fourth and second end closure panels 38*a*, 34*a* are arcuate. In other embodiments it will be appreciated that the second side edge of the fourth and second end closure panels 38*a*, 34*a* may be linear. In some of those embodiments in which the second side edge of the fourth and second end closure panels 38*a*, 34*a* is linear the second side edge may be substantially parallel to the first side edge and/or substantially parallel to the fold line 13 or frangible line 19 respectively; in such embodiments, the second side edge is offset with respect to the fold line 13 or frangible line 19. The fourth and second end closure panels 38*a*, 34*a* may not be tapered in such embodiments.

The second package comprises a second end pull device E comprising an aperture A2 and a recess R2. The aperture A2 is struck in part from the second side wall panel 24 of the second package and in part from the sixth end closure panel 42*b*. The aperture A2 interrupts the fold line 41*b* between the second side wall panel 24 and sixth end closure panel 42*b*. The recess R2 is struck from a first side edge of the fifth end closure panel 40*b*. The aperture A2 and the recess R2 are arranged such that when the blank 10 is assembled into the carton 90, the recess R2 is in registry with a portion of the aperture A2.

Optionally, the fifth end closure panel 40*b* is tapered in shape. The fifth end closure panel 40*b* comprises a second side edge, which opposes the first side edge from which the recess R2 is struck. The second side edge is arranged so as to converge towards the first side edge. In this way, the free end edge of the fifth end closure panel 40*b* is shorter in length dimension than the hinged end edge which is hinged to the outer top wall panel 22 of the second package. A corresponding second side edge of the seventh end closure panel 44*b* is arranged to be contiguous with the second side edge of the fifth end closure panel 40*b* in a set-up carton. The seventh end closure panel 44*b* is also tapered in shape, such that the free end edge of the seventh end closure panel 44*b* is shorter in length dimension than the hinged end edge which is hinged to the bottom wall panel 26 of the second package. In some embodiments the second side edges of the fifth and seventh end closure panels 40*b*, 44*b* are arcuate.

In other embodiments it will be appreciated that the second side edge of the fifth and seventh end closure panels 40*b*, 44*b* may be linear. In some of those embodiments in which the second side edge of the fifth and seventh end closure panels 40*b*, 44*b* is linear, the second side edge may be substantially parallel to the first side edge and/or substantially parallel to the fold line 23 or frangible line 19 respectively; in such embodiments the second side edge is offset with respect to the fold line 23 or frangible line 19. The fifth and seventh end closure panels 40*b*, 44*b* may not be tapered in such embodiments.

In some embodiments the articles being packaged have a substantially circular cross section, that is to say the articles are, at least in part, cylindrical, having a tubular axis which is orientated substantially parallel to the first and second side wall panels 14, 28, 18, 24. In these embodiments a void is provided in the corner of the package adjacent the end pull device. The void or gap is provided between the endmost article in the package and the end wall and/or between the endmost article in the package and the side wall. This void facilitates a user inserting a finger or thumb into the package.

The first side wall panel 14 of the first package comprises a free end edge, that is to say there is no end closure panel hinged to the end edge of the first side wall panel 14. The first side wall panel 28 of the second package comprises a free end edge, that is to say there is no end closure panel hinged to the end edge of the first side wall panel 28. In alternative embodiments the first side wall panel 14 of the first package and the first side wall panel 28 of the second package may comprise a minor end closure panel hinged to each end edge thereof. In embodiments comprising a minor end closure panel, the minor end closure panel may be arranged to facilitate access to the side edge of the adjacent major upper, or lower, end closure panel; for example, but not limited to, the minor end closure panel may comprise an aperture or recess; alternatively the minor end closure panel may not extend fully between the top wall and the base wall, that is to say the minor end closure panel may be shorter in height than the side wall to which it is hinged.

Figure 2:
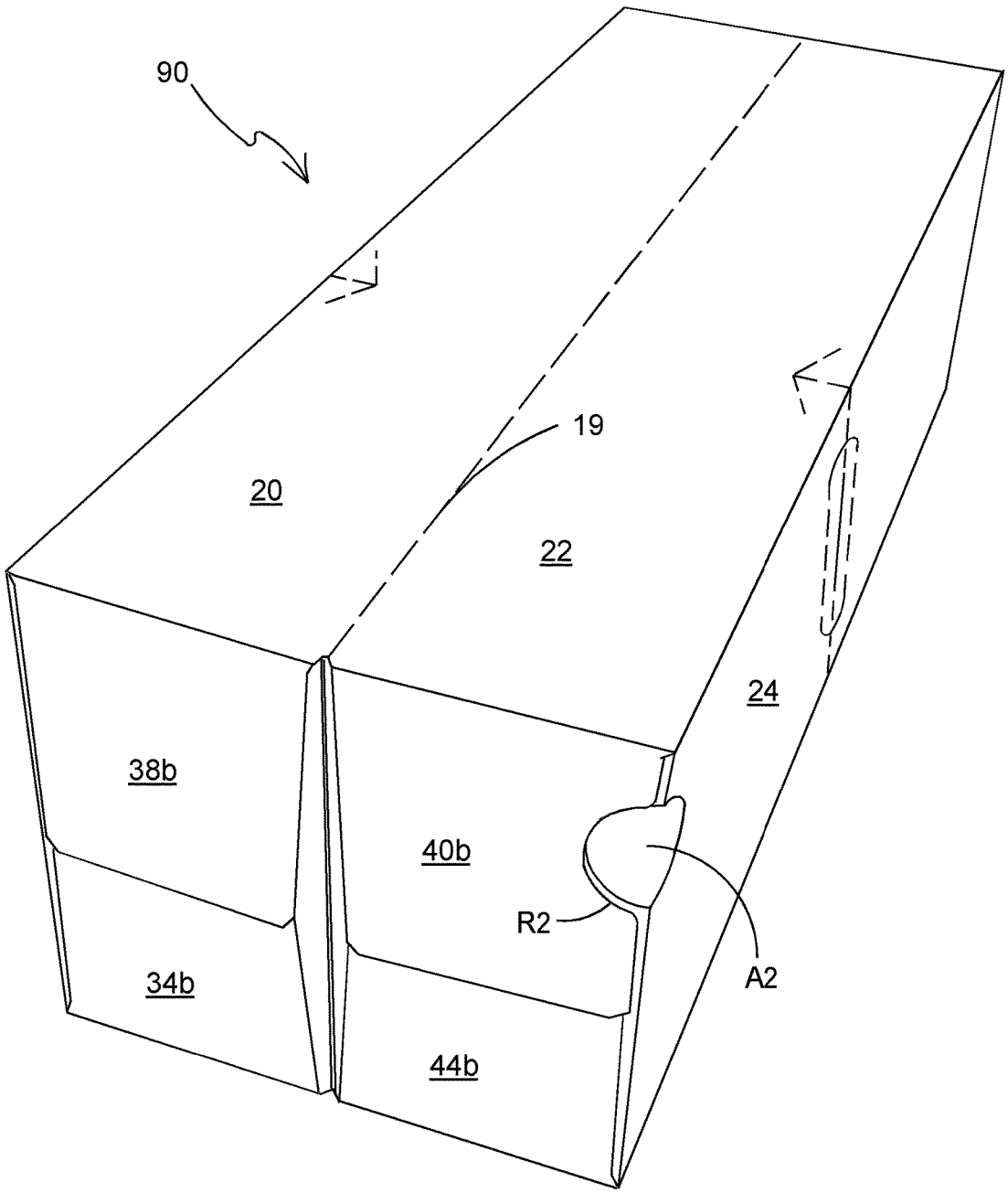
FIG. 2 is a perspective view from above of a carton formed from the blank of FIG. 1.
Figure 4:
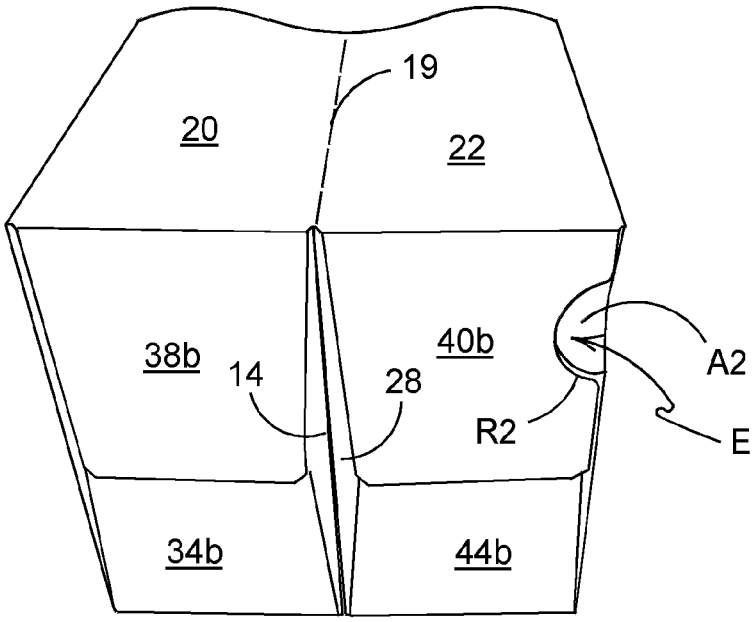

Turning to the construction of the carton 90 as illustrated in FIGS. 2, 3 and 4, it is envisaged that the carton 90 can be formed by a series of sequential folding operations in a straight line machine so that the carton 90 is not required to be rotated or inverted to complete its construction. The folding process is not limited to that described below and may be altered according to particular manufacturing requirements.

In order to form the carton 90, in a first stage the blank 10 is folded to bring the inner top wall panel 12 of the first package into face contacting relationship with the first side wall panel 14 folding the first top wall panel 12 about the fold line 11.

The inner top wall panel 30 of the second package is folded about the fold line 27 to bring the inner top wall panel 30 of the second package into face contacting relationship with the first side wall panel 28.

Glue or other adhesive treatment is applied to the inner top wall panel 12 of the first package.

Glue or other adhesive treatment is applied to the inner top wall panel 30 of the second package.

In alternative embodiments glue or other adhesive treatment is applied to the corresponding portions of each of the outer top wall panels 20, 22 of the first and second packages respectively.

The inner top wall panel 12, first side wall panel 14 and the bottom panel 16 of the first package are folded about the fold line 15 such that the bottom panel 16 is in overlying relationship with the second side wall panel 18. This brings the inner top wall panel 12 into face contacting relationship with the outer top wall panel 20. Pressure may be applied to the first side panel 14 of the first package to secure the inner top wall panel 12 to the outer top wall panel 20.

The inner top wall panel 30, first side wall panel 28 and the bottom panel 26 of the second package are folded about the fold line 23 such that the bottom panel 26 is in overlying relationship with the second side wall panel 24. This brings the inner top wall panel 30 into face contacting relationship with the outer top wall panel 22. Pressure may be applied to the first side panel 28 of the second package to secure the inner top wall panel 30 to the outer top wall panel 22.

Glue or other adhesive treatment is applied to the first side wall panel 14 of the first package and/or to the first side wall panel 28 of the second package.

The blank 10 may then be folded about the frangible line 19 to bring the first side wall panel 14 of the first package into contacting relationship with the first side wall panel 28 of the second package.

In an alternative embodiment, the second side panel 24 of the second package may be folded with respect to the outer top wall panel 22 about the fold line 21. Simultaneously the first side wall panel 28 may be folded with respect to inner top wall panel 30 by unfolding the first side wall panel 28 about the fold line 27. The bottom wall panel 26 may be folded with respect to the first side wall panel 28 by folding about the fold line 25 to place the bottom wall panel 26 in face contacting relationship with the first side wall panel 28. Simultaneously, the bottom wall panel 26 is folded with respect to the second side wall panel 24, by unfolding the bottom wall panel 26 about the fold line 23. In this way the portion of the blank 10 forming the second package is folded into a flat collapsed state which overlies the portion of the blank 10 forming the first package which is also in folded, flat collapsed condition. This provides a carton 90, which is in a flat collapsed state in which it can be shipped and distributed to a converter plant. It will be appreciated that this alternative folding method could be readily modified to bring the portion of the blank 10 forming the first package into a flat, folded, collapsed state which overlies the portion of the blank 10 forming the second package which is also in a folded, flat, collapsed condition. These alternative methods avoid folding the blank 10 about the frangible line 19 and thus reduce the risk of the first and second packages becoming separated during assembly and filling of the carton 90.

The carton 90 may be erected into a tubular structure by engaging with a pair of adjacent walls of the carton 90 and folding said adjacent walls such that they are disposed perpendicularly with respect to each other.

The erected tubular structure is loaded with articles through one or both open ends of each package. One or more of the end closure panels 32*a*, 34*a*, 36*a*, 38*a*, 32*b*, 34*b*, 36*b*, 38*b*, 40*a*, 42*a*, 44*a*, 46*a*, 40*b*, 42*b*, 44*b*, 46*b* may be folded outwardly to act as a funnel to facilitate insertion of the articles into the carton 90.

Once the articles are loaded into the tubular structure, the ends of the tubular structure are closed. A first end of the first package is closed by folding the third end closure panel 36*a* about fold line 35*a*. Glue or other adhesive treatment may be applied to an outer surface of the second end closure panel 34*a*. In alternative embodiments the glue or adhesive treatment may be applied to an inner surface of the corresponding region of the first, second and fourth end closure panels

32*a*, 34*a*, 38*a*. The second end closure panel 34*a* is then folded about the fold line 33*a* and is optionally secured to the third end closure panel 36*a*. Glue or adhesive treatment is applied to an outer surface of the second end closure panel 34*a*. In an alternative embodiment glue or adhesive treatment is applied to an inner surface of the fourth end closure panel 38*a* and/or to the first end closure panel 32*a*. The fourth end closure panel 38*a* is folded about fold line 37*a* and brought into contact with the second end closure panel 34*a* such that part of the fourth end closure panel 38*a* is in overlapping relationship with part of the second end closure panel 34*a* and is secured and affixed thereto. The first end closure panel 32*a*, which is secured to the inner surface of the fourth end closure panel 38*a*, is folded about arcuate fold lines 31*a*, simultaneously with the fourth end closure panel 38*a* being folded about fold line 37*a*.

A second end of the first package is closed by folding the seventh end closure panel 36*b* about fold line 35*b*. Glue or other adhesive treatment may be applied to an outer surface of the seventh end closure panel 36*b*. In alternative embodiments the glue or adhesive treatment may be applied to an inner surface of the corresponding regions of the fifth, sixth and eighth end closure panels 32*b*, 34*b*, 38*b*. The sixth end closure panel 34*b* is folded about the fold line 33*b* and optionally secured to the seventh end closure panel 36*b*. Glue or adhesive treatment is applied to an outer surface of the sixth end closure panel 34*b*. In an alternative embodiment glue or adhesive treatment is applied to an inner surface of the eighth end closure panel 38*b* and/or the fifth end closure panel 32*b*. The eighth end closure panel 38*b* is folded about fold line 37*b* and brought into contact with the sixth end closure panel 34*b* such that a portion of the eighth end closure panel 38*b* is in overlapping relationship with a portion of the sixth end closure panel 34*b* and is secured thereto. The fifth end closure panel 32*b*, which is secured to the inner surface of the eighth end closure panel 38*b*, is folded about arcuate fold lines 31*b*, simultaneously with the eighth end closure panel 38*b* being folded about fold line 37*b*.

A first end of the second package is closed by folding the second end closure panel 42*a* about fold line 41*a*. Glue or other adhesive treatment may be applied to an outer surface of the second end closure panel 42*a*. In alternative embodiments the glue or adhesive treatment may be applied to an inner surface of the corresponding regions of the first, third and fourth end closure panels 40*a*, 44*a*, 46*a*. The third end closure panel 44*a* is then folded about the fold line 43*a* and is optionally secured to the second end closure panel 42*a*. Glue or adhesive treatment is applied to an outer surface of the third end closure panel 44*a*. In an alternative embodiment glue or adhesive treatment is applied to an inner surface of the first end closure panel 40*a* and/or fourth end closure panel 46*a*. The first end closure panel 40*a* is folded about fold line 39*a* and brought into contact with the third end closure panel 44*a* such that part of the first end closure panel 40*a* is in overlapping relationship with part of the third end closure panel 44*a* and is secured and affixed thereto. The fourth end closure panel 46*a*, which is secured to the inner surface of the first end closure panel 40*a*, is folded about arcuate fold lines 47*a*, simultaneously with the first end closure panel 40*a* being folded about fold line 39*a*.

A second end of the second package is closed by folding the sixth end closure panel 42*b* about fold line 41*b*. Glue or other adhesive treatment may be applied to an outer surface of the sixth end closure panel 42*b*. In alternative embodiments the glue or adhesive treatment may be applied to an inner surface of the corresponding regions of the fifth, seventh and eighth end closure panels 40*b*, 44*b*, 46*b*. The seventh end closure panel 44*b* is folded about the fold line 43*b* and optionally secured to the sixth end closure panel 42*b*. Glue or adhesive treatment is applied to an outer surface of the seventh end closure panel 44*b*. In an alternative embodiment glue or adhesive treatment is applied to an inner surface of the fifth end closure panel 40*b* and/or to an inner surface of the eighth end closure panel 46*b*. The fifth end closure panel 40*b* is folded about fold line 39*b* and brought into contact with the seventh end closure panel 44*b* such that a portion of the fifth end closure panel 40*b* is in overlapping relationship with a portion of the seventh end closure panel 44*b* and is secured thereto. The eighth end closure panel 46*b*, which is secured to the inner surface of the fifth end closure panel 40*b*, is folded about arcuate fold lines 47*b*, simultaneously with the fifth end closure panel 40*b* being folded about fold line 39*b*.

In some embodiments one end of the tubular structure may be closed before loading articles through a remaining open end of the tubular structure.

Figure 5:
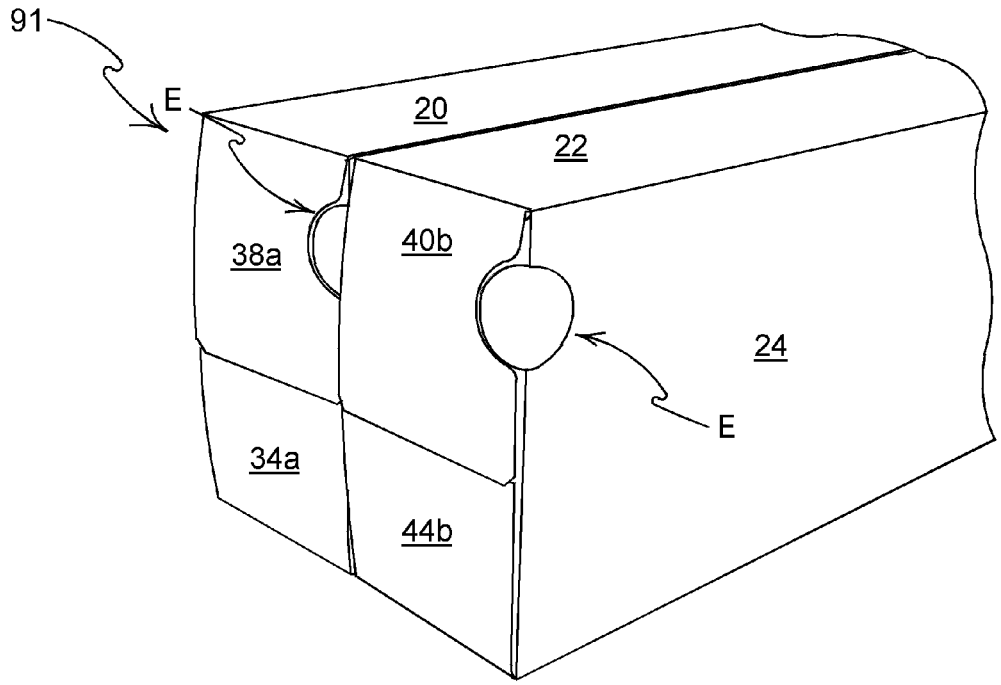
FIG. 5 is a perspective view from above of end portions of a pair of packages formed from the carton of FIG. 2.
Figure 6:
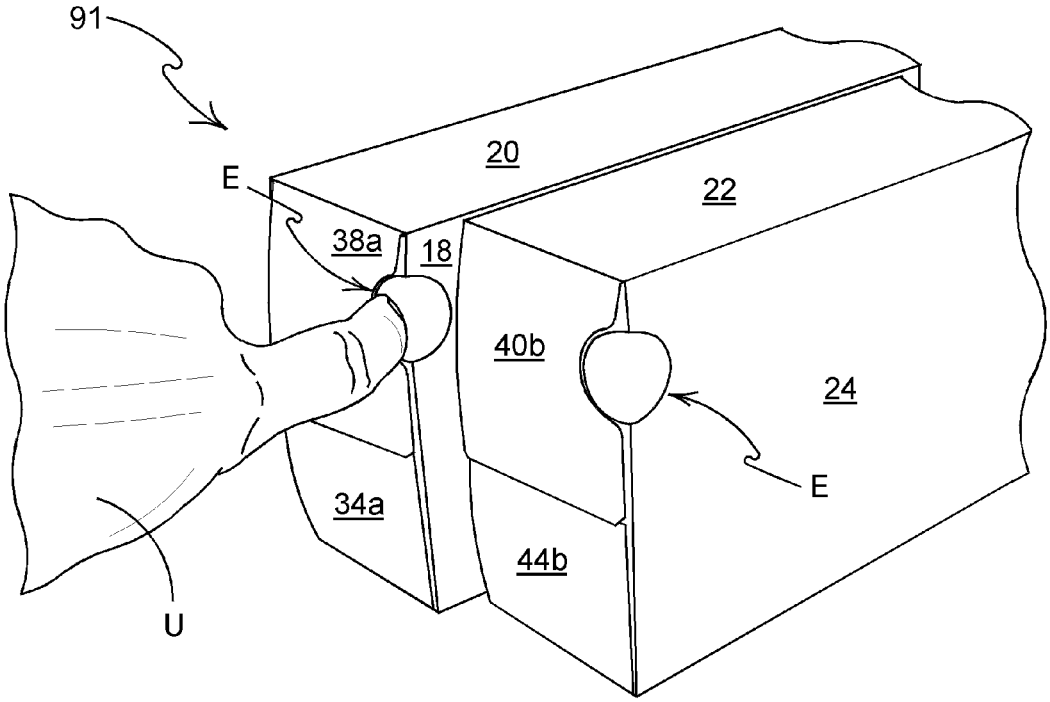
FIG. 6 is a perspective view from above of the end portions of the pair of packages of FIG. 4 illustrating a user withdrawing one package with respect to the other package.

FIGS. 5 and 6 illustrate the first and second packages 91 in a separated condition. A retailer has severed the frangible line 19 such that the first package is separate to the second package. In those embodiments in which the first side wall panel 14 of the first package is glued to the first side wall panel 28 of the second package, the retailer severs or breaks the glue connection. In some embodiments the first side wall panel 14, 28 of the first and/or second package may comprise one or more glue locations which are surrounded by a half-cut perforation. In this way the retailer may readily, controllably and neatly tear an outer layer or skin of the substrate forming the first side wall panel 14, 28.

Once the retailer has separated the first package from the second package, the retailer rotates the first package with respect to the second package such that the end pull device of each of the first and second packages face the same direction. In this way, when the first and second packages are disposed upon a shelf (not shown), or other display apparatus, both the end pull devices E face the consumer. In this way, when the consumer wishes to withdraw one package from the shelf, they may employ the end pull device E of one of the packages located on the shelf, see FIG. 6.

Figure 7:
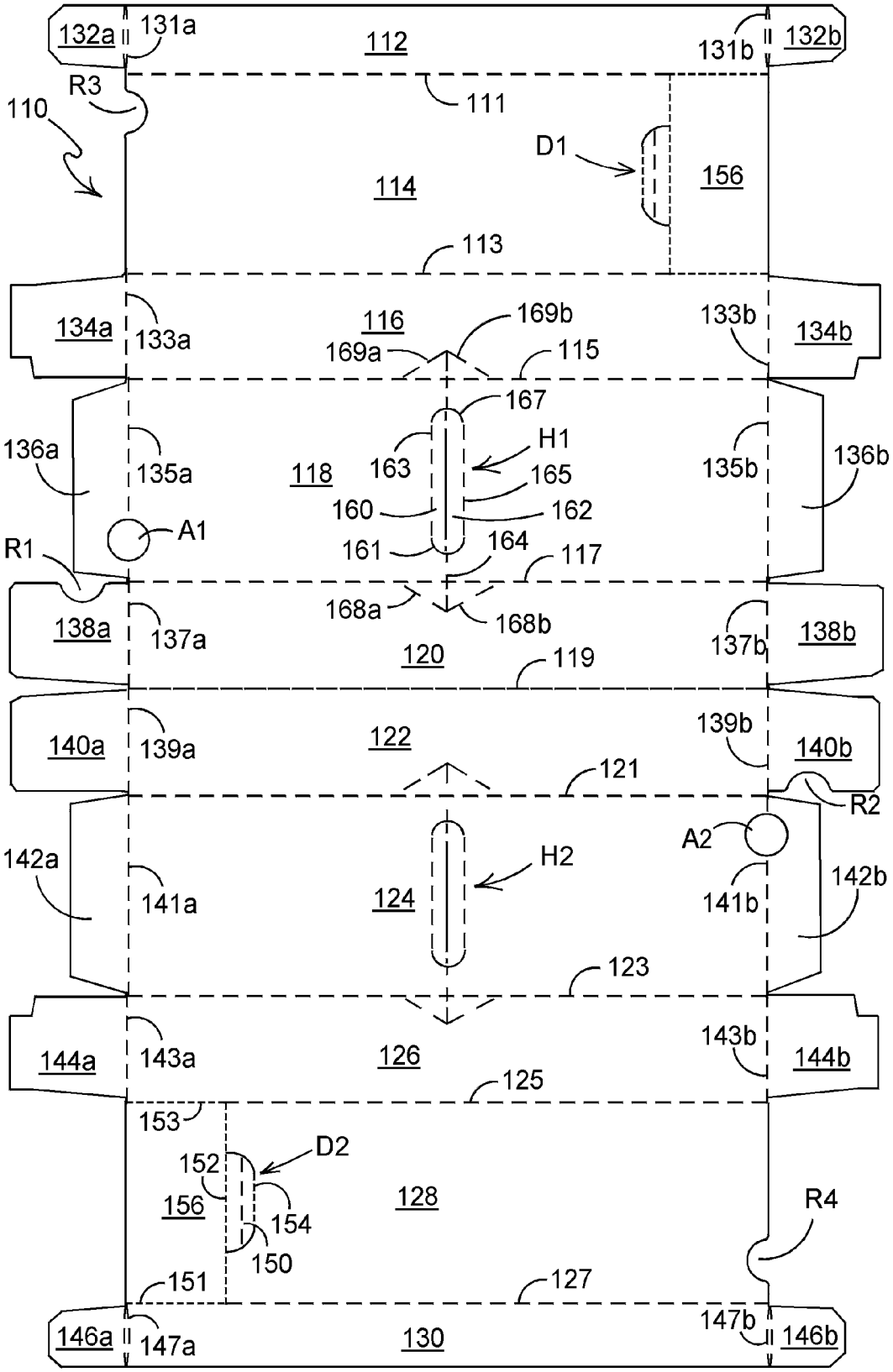
FIG. 7 is a plan view from above of a blank for forming a carton according to a second embodiment of the invention.
Figure 8:
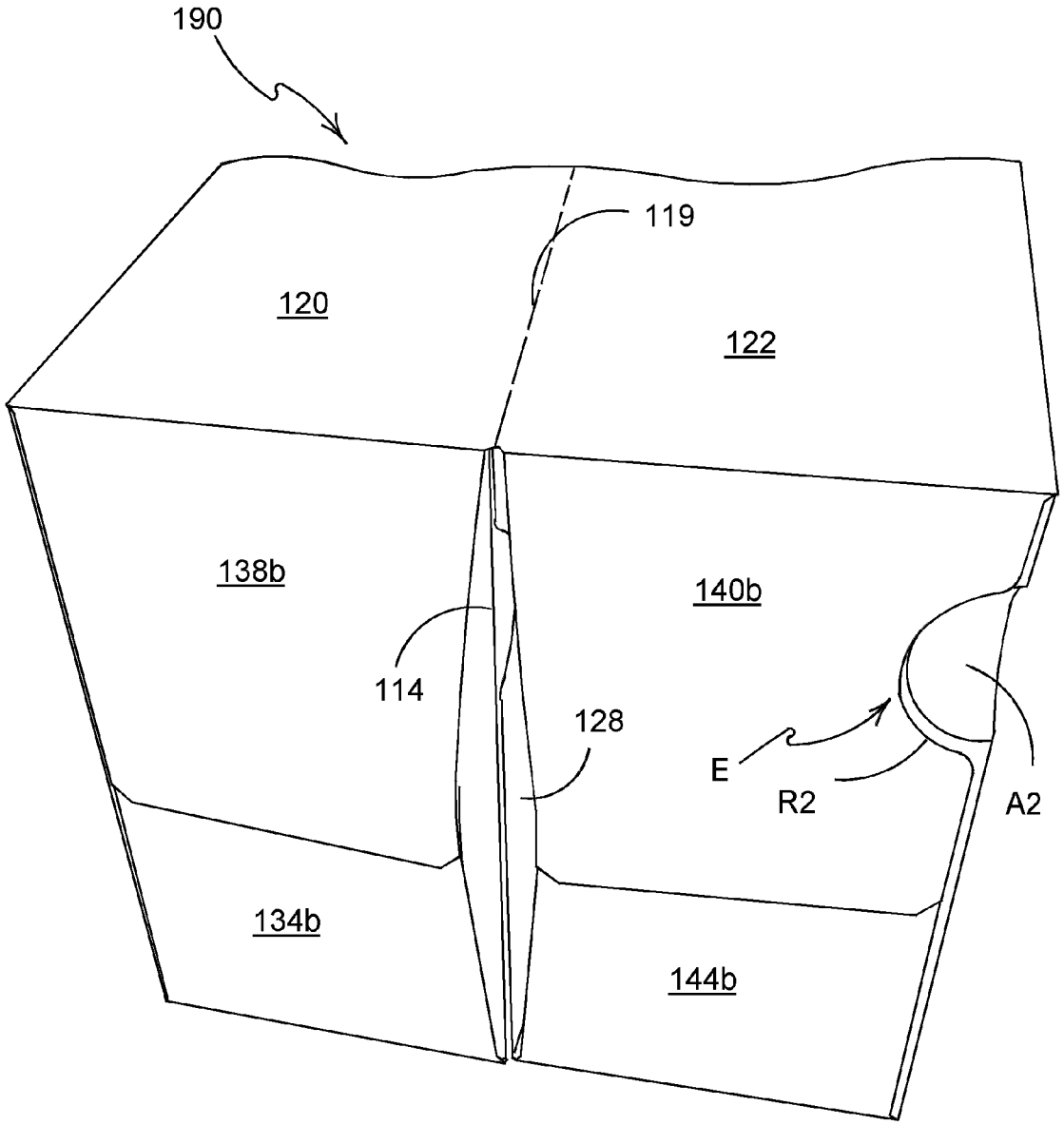
FIG. 8 is a perspective view from above of an end portion of a carton formed from the blank of FIG. 7.

Referring now to FIGS. 7 and 8, there is shown an alternative embodiment of the present invention. In the second illustrated embodiment, like numerals have, where possible, been used to denote like parts, albeit with the addition of the prefix "100" to indicate that these features belong to the second embodiment. The alternative embodiment shares many common features with the first embodiment and therefore only the differences from the embodiment illustrated in FIGS. 1 to 6 will be described in any greater detail.

The blank 110 comprises a third recess R3 struck from, or otherwise defined in, the first side wall panel 114 of the first package and a fourth recess R4 struck from, or otherwise defined in, the first side wall panel 128 of the second package.

The third recess R3 is located on an end edge of the first side wall panel 114 of the first package. The third recess R3 is disposed adjacent to the fold line 111 such that in a set-up carton the third recess R3 is at substantially the same elevation as the recess R1 and the aperture A1.

The fourth recess R4 is located on an end edge of the first side wall panel 128 of the second package. The fourth recess R4 is disposed adjacent to the fold line 127 such that in a set-up carton the fourth recess R4 is at substantially the same elevation as the recess R2 and the aperture A2.

The blank 110 is constructed and erected using the method previously described with regard to the embodiment of FIGS. 1 to 6.

In this way the blank 110 forms a carton 190, see FIG. 8, in which the third recess R3 and fourth recess R4 are disposed at opposite ends of the carton. The fourth recess R4 is disposed upon the internal divider structure between the first and second package. The third recess R4 is disposed upon the internal divider structure between the first and second package.

Figure 9:
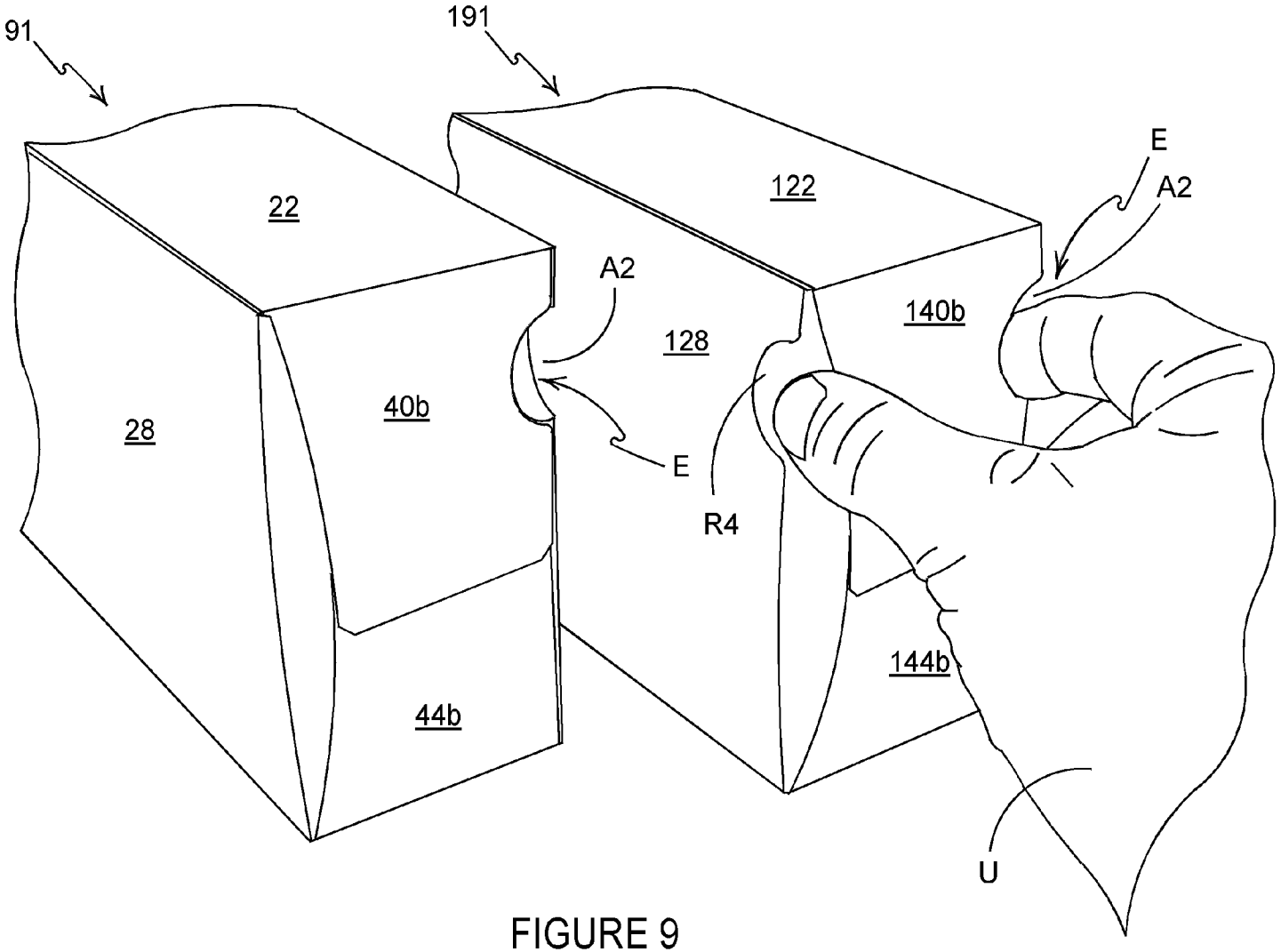
FIG. 9 is a perspective view from above of an end portion of a package formed from the blank of FIG. 1 and an end portion of a package formed from the blank of FIG. 7, illustrating a user engaging the package formed from the blank of FIG. 7.

When the first and second packages of the carton 190 are separated from each other, see the second package 191 illustrated in FIG. 9, the fourth recess R4 facilitates access to a side edge of the fifth end closure panel 140*b*. In this way the user U can grasp opposing side edges of the fifth end closure panel 140*b*.

Figure 10:
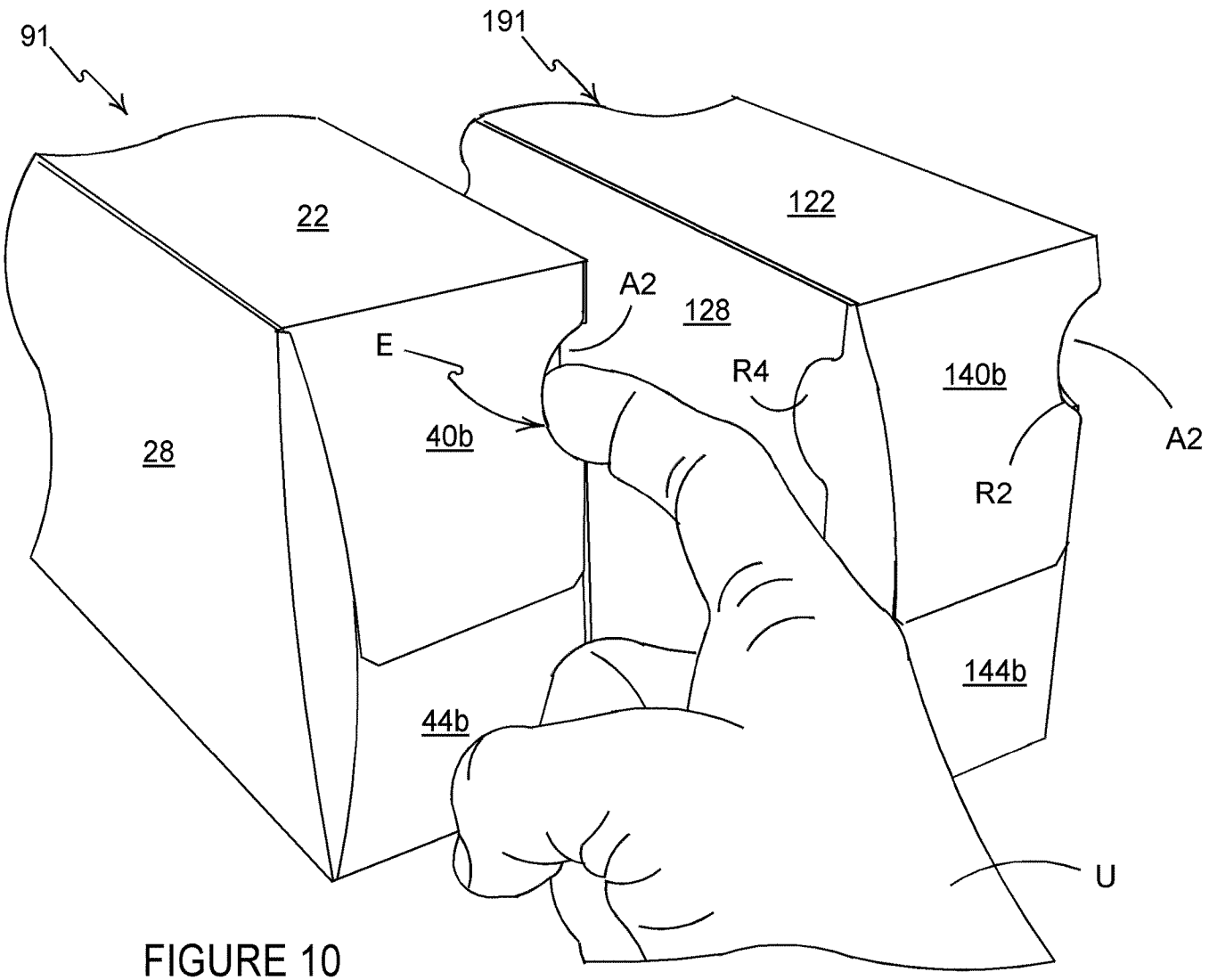
FIG. 10 is a perspective view from above of an end portion of a package formed from the blank of FIG. 1 and an end portion of a package formed from the blank of FIG. 7, illustrating a user engaging the package formed from the blank of FIG. 1.

FIGS. 9 and 10 illustrate the second package 91 of the first embodiment of FIG. 1 alongside the second package 191 of the second embodiment. In FIG. 9 a user U is employing the end pull device E by engaging opposing side of the fifth end closure panel 140*b* of the second package of the second embodiment whereas in FIG. 10 a user U is engaging an opposing side of the fifth end closure panel 40*b* of the second package of the first embodiment.

It can be appreciated that various changes may be made within the scope of the present invention. For example, the size and shape of the panels and apertures may be adjusted to accommodate articles of differing size or shape. It will be appreciated that the end pull device E of any of the embodiments disclosed herein may be employed in a carton which is not divisible.

It will be recognized that as used herein, directional references such as "top", "bottom", "front", "back", "end", "side", "inner", "outer", "inside", "outside", "upper" and "lower" do not necessarily limit the respective panels to such orientation, but may merely serve to distinguish these panels from one another.

As used herein, the term "weakened line of severance" or "frangible line" refers to all manner of lines that facilitate separating portions of the substrate from one another or that indicate optimal separation locations. Weakened lines of severance may be frangible or otherwise weakened lines, tear lines, cut lines, or slits.

As used herein, the term "hinged connection" refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines.

As used herein, the term "fold line" refers to one of the following: a scored line, an embossed line, a debossed line, a line of perforations, a line of short slits, a line of half-cuts, a single half-cut, an interrupted cut line, aligned slits, a line of scores and any combination of the aforesaid options.

As used herein, the term "weakened line of severance", "frangible line", "severance line" or "tear line" refers to all manner of lines formed in a substrate of sheet material, that facilitate separating portions of the substrate from one another, or otherwise indicate optimal separation locations on the substrate. For example, a severance line or tear line in a substrate of sheet material is predisposed to allow a tear to propagate there along. A weakened line of severance, frangible line, severance line or tear line may be one of the following: a single cut, a single half-cut, a single slit, an interrupted cut, a score line, an interrupted score line, a line of perforations, a line of short cuts, a line of short slits, a line of short half cuts, and any combination of the aforementioned options.

It should be understood that hinged connections, weakened lines of severance, frangible lines, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to alignment of two or more elements in an erected carton, such as a recess formed in a first of two overlapping panels and an aperture formed in a second of two overlapping panels. Those elements in registry with each other may be aligned with each other in the direction of the thickness of the overlapping panels. For example, when a recess in a first panel is "in registry with" an aperture in a second panel that is placed in an overlapping arrangement with the first panel, an edge of the recess may extend along at least a portion of an edge of the aperture and may be aligned, in the direction of the thickness of the first and second panels, with the aperture.

It should also be understood that the term "display apparatus" used in this application refers to, but not limited to, a shelf, a rack, a display cart and even a stack or pile of cartons of the same structure as the carton of the invention, in which the carton of the invention is included.

The invention claimed is:

1. A carton for packaging articles comprising a first plurality of walls including a top wall, base wall, first side wall and second side wall forming a first tubular structure, each end of the first tubular structure being at least partially closed by at least a first end closure panel and a second end closure panel, wherein the carton comprises an end pull device for withdrawing the carton from a display apparatus wherein the end pull device comprises a first recess defined at an end of the first side wall panel so as to facilitate access to an edge of the second end closure panel at an adjacent end of the first tubular structure, wherein the first end closure panel comprises a second recess defined along an edge thereof, wherein the second end closure panel is hinged to the end of the first side wall panel, and a third recess is struck from the second end closure panel, the first recess and the third recess together forming an aperture which interrupts a hinged connection between the second end closure panel and the first side wall panel.

2. A carton according to claim 1 wherein the second recess struck from the edge of the first end closure panel is arranged to be in registry with at least a portion of the aperture when the first end closure panel is disposed in overlapping relationship with the second end closure panel.

3. A carton according to claim 1 wherein the end pull device comprises a fourth recess struck from an end of the second side wall panel.

4. A carton according to claim 3 wherein the fourth recess is disposed at an elevation above the base panel substantially equal to the elevation of the first recess.

5. A carton according to claim 1 wherein the second side wall panel comprises a free end which is connected to no other part of the carton.

6. A carton according to claim 1 comprising a second plurality of walls including a top wall, base wall, first side wall and second side wall forming a second tubular structure, each end of the second tubular structure being at least partially closed by one or more end closure panels, wherein the carton comprises a second end pull device for withdrawing the carton from a display apparatus wherein the second end pull device comprises a first recess defined at an end of the first side wall panel of the second tubular structure so as to facilitate access to an edge of the one or more end closure panels at the adjacent end of the second tubular structure.

7. A carton according to claim 6 wherein the top wall of the second tubular structure is coupled to the top wall of the first tubular structure by a frangible connection, wherein the first tubular structure forms part of a first package and the second tubular structure forms part of a second package, and wherein the first package is detachably connected to the second package.

8. A carton according to claim 6 wherein the first end pull device is disposed at a first end of the carton and the second end pull device is disposed at second end of the carton, the second end opposing the first end.

9. A carton according to claim 6 wherein the second side wall panel of the first package and the second side wall panel of the second package are disposed in face contacting relationship with each other to form an internal divider structure between two adjacent rows of articles to be received in the carton.

10. A carton according to claim 9 wherein the second side wall panel of the first package and the second side wall panel of the second package are secured to each other by glue or other adhesive treatment.

11. A carton for packaging articles comprising a first plurality of walls including a top wall, base wall, first side wall and second side wall forming a first tubular structure, each end of the first tubular structure being at least partially closed by at least a first end closure panel and a second end closure panel to form a first package, wherein the carton further comprises a first end pull device for withdrawing the first package from a display apparatus, wherein the first end pull device comprises a first recess defined at an end of the first side wall panel of the first tubular structure to facilitate access to an edge of the second end closure panel at an adjacent end of the first tubular structure, wherein the first end closure panel comprises a second recess defined along an edge thereof, wherein the second end closure panel is hinged to the end of the first side wall, and a third recess is struck from the second end closure panel, the first recess and the third recess together forming an aperture which interrupts a hinged connection between the second end closure panel and the first side wall, the carton further comprising a second plurality of walls including a top wall, base wall, first side wall and second side wall forming a second tubular structure, each end of the second tubular structure being at least partially closed by one or more end closure panels to form a second package, wherein the carton further comprises a second end pull device for withdrawing the second package from a display apparatus, wherein the second end pull device comprises a second recess defined at an end of the first side wall of the second tubular structure to facilitate access to an edge of the one or more end closure panels at an adjacent end of the second tubular structure, and wherein the first package is frangibly connected to the second package.

12. A carton according to claim 11 wherein the first end pull device is disposed at a first end of the carton and the second end pull device is disposed at second end of the carton, the second end opposing the first end.

13. A carton according to claim 11 wherein the first end pull device comprises a fourth recess struck from an end of the second side wall.

14. A carton according to claim 13 wherein the fourth recess is disposed at an elevation above the base wall substantially equal to the elevation of the first recess.

15. A blank for forming a carton comprising a first plurality of panels for forming a first tubular structure including a top wall, base wall, first side wall and second side wall in a set-up condition, the blank comprising at least a first end closure panel and a second end closure panel for at least partially closing each end of the first tubular structure, wherein the blank further comprises an end pull device for withdrawing a set-up carton from a display apparatus wherein the end pull device comprises a first recess defined at an end of the first side wall panel to facilitate access to an edge of the second end closure panel at an adjacent end of the first tubular structure, wherein the first end closure panel comprises a second recess defined along an edge thereof, wherein the second end closure panel is hinged to the end of the first side wall panel, and a third recess is struck from the second end closure panel, the first recess and the third recess together forming an aperture which interrupts a hinged connection between the second end closure panel and the first side wall panel.

16. A blank according to claim 15, further comprising a second plurality of panels for forming a second tubular structure including a top wall, base wall, first side wall and second side wall in a set-up condition, the blank further comprising one or more end closure panels for at least partially closing each end of the second tubular structure to form a second package, wherein the blank further comprises a second end pull device for withdrawing the second package when in a set-up condition from the display apparatus and wherein the second end pull device comprises a second recess defined at an end of the first side wall panel of the second tubular structure so as to facilitate access to an edge of the one or more end closure panels at an adjacent end of the second tubular structure, and wherein the first plurality of panels are frangibly connected to the second plurality of panels.

17. A carton according to claim 15 wherein the end pull device comprises a fourth recess struck from an end of the second side wall panel.

18. A carton according to claim 17 wherein the fourth recess is disposed at an elevation above the base panel substantially equal to the elevation of the first recess.

* * * * *